United States Patent [19]

Violi

[11] 4,081,002

[45] Mar. 28, 1978

[54] TOOL FOR TIGHTENING CLAMPS

[75] Inventor: Mario Violi, Totes, France

[73] Assignee: Legrand S.A., Limoges, France

[21] Appl. No.: 771,395

[22] Filed: Feb. 23, 1977

[30] Foreign Application Priority Data

Feb. 27, 1976 France ..... 76 05486

[51] Int. Cl.[2] ..... B21F 9/02

[52] U.S. Cl. ..... 140/123.6; 140/93.2

[58] Field of Search ..... 140/93, 93 A, 93.2, 140/123.5, 123.6

[56] References Cited

U.S. PATENT DOCUMENTS

| | | | |
|---|---|---|---|
| 3,610,296 | 10/1971 | Kabel | 140/93.2 |
| 3,661,187 | 5/1972 | Caveney et al. | 140/123.6 |
| 3,735,784 | 5/1973 | Obuch et al. | 140/93.2 |
| 3,752,199 | 8/1973 | Fekete | 140/123.6 |
| 3,782,426 | 1/1974 | Morgan et al. | 140/123.6 |
| 3,830,263 | 8/1974 | Benfer | 140/93.2 |
| 3,853,155 | 12/1974 | Kabel | 140/123.6 |
| 3,865,156 | 2/1975 | Moody et al. | 140/123.6 |
| 3,931,838 | 1/1976 | Bakermans | 140/123.6 |

*Primary Examiner*—E. M. Combs

*Attorney, Agent, or Firm*—Henry R. Lerner

[57] ABSTRACT

In a tool for tightening clamps, of the kind comprising a flexible strip and an apertured head, having a passage in which the end of the flexible strip can be engaged after the strip has been passed around a bunch of articles to be clamped together and through the apertured head, the tool being used to cut-off that portion of the flexible strip of the clamp which projects beyond the apertured head following tightening to a greater or lesser degree of the clamp around the articles, the improvement comprising a displacement member, a trigger and coupling means including a swinging link provided between the displacement member and the trigger and including a sudden release mechanism comprising a cam having a cam surface with two separate stable zones separated from one another by an unstable zone and a cam-follower maintained in contact with the cam surface of the cam, the cam and the cam-follower being relatively movable to swing said cutting lever from a rest position into a working position, one of the cam and the cam-follower being fixed to a trigger and the other being provided on a swinging link of the coupling means provided between the trigger and the displacement member, elastic calibrating means coupled to the swinging link and engagement means for the swinging link engaged with complementary engagement means fixed to the cutting lever. Preferably the cam is formed on the swinging link and the swinging link is formed to define a heart-shaped hole, opposite sides of which hole define the stable zones of the cam surface and the cam-follower comprises a pin integral with the trigger and engaged in the heart-shaped hole.

13 Claims, 7 Drawing Figures

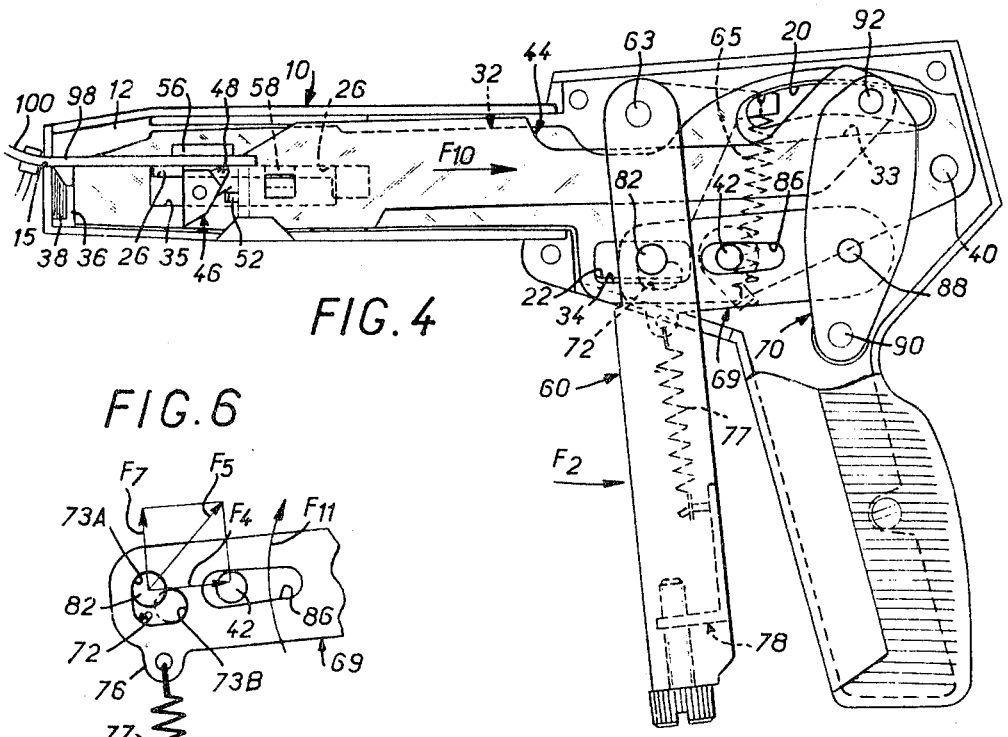
FIG. 4
FIG. 6
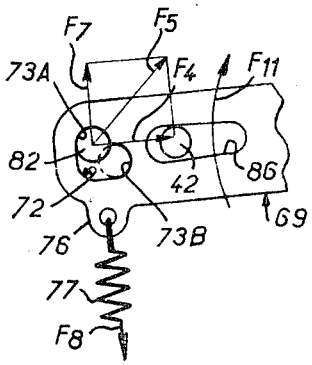
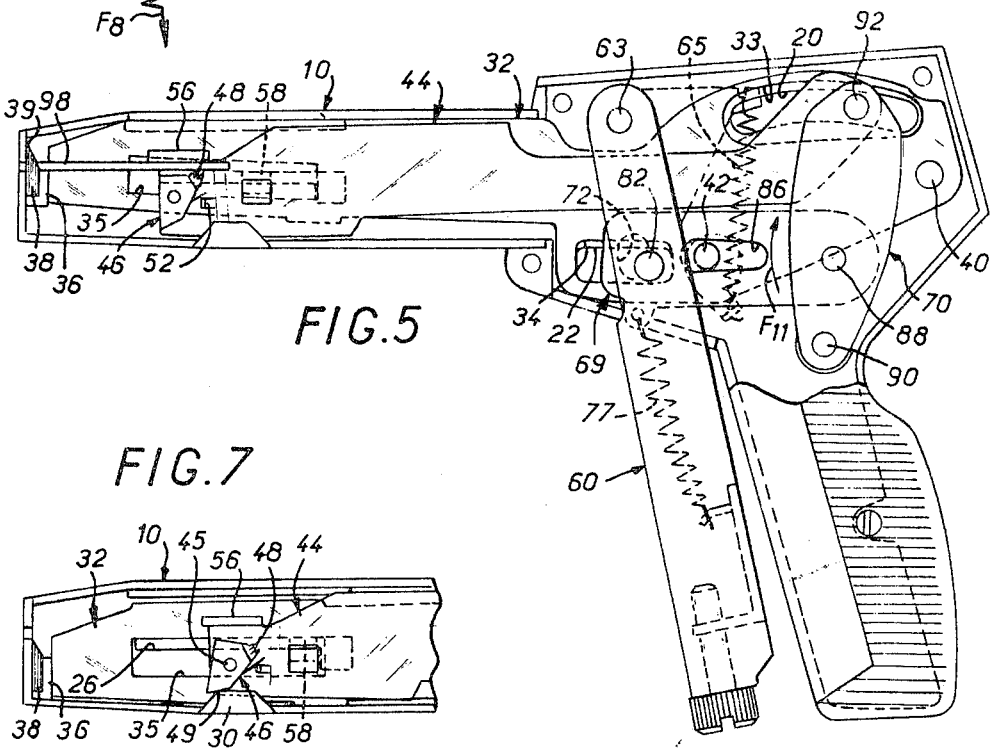
FIG. 5
FIG. 7

TOOL FOR TIGHTENING CLAMPS

BACKGROUND OF THE INVENTION

The invention relates to a tool for tightening clamps, of the kind comprising a flexible strip and an apertured head, having a passage in which the end of the flexible strip can be engaged after the strip has been passed around a bunch of articles to be clamped together, for example electrical cables or conductors, and through the apertured head, the tool being operated to cut-off that portion of the flexible strip of the clamp which projects beyond the apertured head following tightening to a greater or lesser degree of the clamp around the articles.

The invention has among its objects to provide a tool of the kind described hereinbefore which in advantageous manner is simple and robust but easy and reliable to use.

SUMMARY OF THE INVENTION

According to the invention there is provided a tool for tightening clamps, of the kind comprising a flexible strip and an apertured head, having a passage in which the end of the flexible strip can be engaged after the strip has been passed around a bunch of articles to be clamped together and through the apertured head, the tool being used to cut-off that portion of the flexible strip of the clamp which projects beyond the apertured head following tightening to a greater or lesser degree of the clamp around the articles, the tool comprising a plate having a transverse portion at one of its ends formed to define an intake opening to receive said portion of the flexible strip of a clamp and at the other of its ends a fixed grip; a displacement member mounted for movement longitudinally of said plate and including means capable of gripping said portion of a clamp; a trigger pivotally mounted on said plate for movement relative to said fixed grip; coupling means including a swinging link provided between said displacement member and said trigger and including a release mechanism controlled by elastic calibrating means; a cutting lever pivotally mounted between a rest position where it leaves free said intake opening of said plate and a working position and with which are associated restoring means which draw said cutting levers in the direction of said rest position; said release mechanism comprising a cam having a cam surface with two separate stable zones separated from one another by an unstable zone and a cam follower maintained in contact with the cam surface of the cam by elastic calibrating means, said cam and said cam-follower being relatively movable within limits defined by said cam surface thereby to swing said cutting lever from said rest position into said working position, one of said cam and said cam follower being fixed to said trigger and the other being provided on said swinging link of said coupling means provided between said trigger and said displacement member, said elastic calibrating means being coupled to said swing link and said swinging link having engagement means fixed to said cutting lever.

An operator of the tool grasps the tool by its fixed grip in the manner of a pistol and acts on the movable grip formed by the trigger, after engaging the tool by its intake opening on the free end to be cut of the clamp in question, the said free end of the clamp is displaced and the latter is tightened on the articles which it grips, said displacement continuing with a concomitent tensioning of the clamp until the sudden release mechanism comes into action and brings about the cutting-off of the free end of the clamp.

Any random one of the cam and the cam follower of the sudden release mechanism thereof can be integral with the trigger whilst the other is formed on the swinging link of the coupling linkage established between the trigger and the associated displacement member to which are coupled the elastic calibrating means and which has engagement means such as a supporting surface engaged with complementary engagement means, such as a lug, joined to the cutting lever.

According to a preferred embodiment, the cam is formed on the swinging link, whereby the latter has a heart-shaped hole, whose one side forms the corresponding cam surface and which is traversed by a pin joined to the movable grip forming the trigger.

The swinging link can advantageously be in the form of an appropriately cut and optionally hardened metal plate.

This simply cut swinging link is advantageously very robust and in a particularly economic manner can be used without any special machining thereof being necessary.

Moreover, the elastic calibrating means controlling the sudden release of the sudden release mechanism are preferably coupled to said swinging link and according to an advantageous development of the invention said elastic calibrating means are located in the trigger, providing for particularly easy access thereto and therefore facilitating the adjustment thereof.

In an also preferred manner, the swinging link is in engagement with an amplification link of the coupling linkage established between the displacement member and the trigger, said amplification link being articulated on the one hand to the support plate and on the other to said displacement member.

Due to the provision of said amplification link the longitudinal displacement of the swinging link during the utilisation of the tool is advantageously reduced although the concomitant longitudinal displacement of the displacement member is large, which advantageously limits wear due to such displacement to said swinging link.

Moreover, said amplification link preferably extends substantially in accordance with the fixed grip of the plate and, through superimposing over at least part thereof it can advantageously be included in the overall contour of such a fixed grip so as to constitute in the manner of the butt of a pistol, a sufficient hold for the operator who operates the tool.

Thus, the provision of such an amplification link has no effect on the overall dimensions of the tool, no matter what length is in practice given to said link and no matter what reduction ratio it provides.

It is thus possible on the basis of a common mechanism to provide, as required, a tool whose displacement members can effect different travels, by suitably selecting the length of the amplification link used.

Thus, it is possible without any concomitant increase in the overall dimensions due to other components of the tool to give a considerable length to a barrel-portion of the tool in which is movably fitted in conventional manner the displacement member thereof, which increase the possibilities of using the tool and more particularly its capacity for remotely reaching working areas which are normally difficult of access, such as for example occur in the corners of cubicles in which are fitted electrical equipment and/or in the case of cabling to be made behind stranded wires.

Thus, as stated hereinbefore, it is merely necessary to give the amplification link a sufficient length.

Moreover, the cutting lever is advantageously articulated at a point on the support plate close to the end thereof opposite to the end of said support plate which has the intake opening for engaging a clamp.

Therefore, to change from the rest position of said cutting lever to the working position thereof necessary for cutting such a clamp, it is merely necessary for there to be a limited pivoting of the swinging link which firstly and in advantageous manner limits wear to such a link due to pivoting and secondly, linked with the fact that the sudden release mechanism of the tool is mainly located level with the apex portion of the fixed grip of the tool makes it possible to limit the transverse dimensions of the barrel-portion of the tool, so that said barrel-portion can be made very thin which aids access to difficult working areas.

Moreover, the sudden release mechanism permits an advantageous disconnection between the tensioning of the clamp and the cutting thereof, whereby the force necessary for cutting is developed solely by the associated elastic calibrating means, independently of the force exerted by the operator on the trigger.

According to the development of the invention, it is also possible to cut a clamp without the prior tensioning of the latter.

The tool can be advantageously equipped with a retractable stop which is able to limit the path of the displacement member, no matter what the action zone of said stop, whereby said stop is able by itself to prevent the coming into operation of the sudden release mechanism which grips the clamp gripped by the displacement member.

The invention is diagrammatically illustrated by way of example in the accompanying drawings.

BRIEF DESCRIPTION OF THE DRAWINGS

In the drawings

FIGS. 3, 4 and 5 are views similar to FIG. 1 illustrating the use of the tool according to the invention;

FIG. 6 shows to a greater scale, a fragmentary view of swinging rod of the tool of FIGS. 1 to 5; and FIG. 7 is a fragmentary view of part of FIG. 5 illustrating a final phase of use of the tool of FIGS. 1 to 5.

DESCRIPTION OF THE PREFERRED EMBODIMENT

Figure 1:
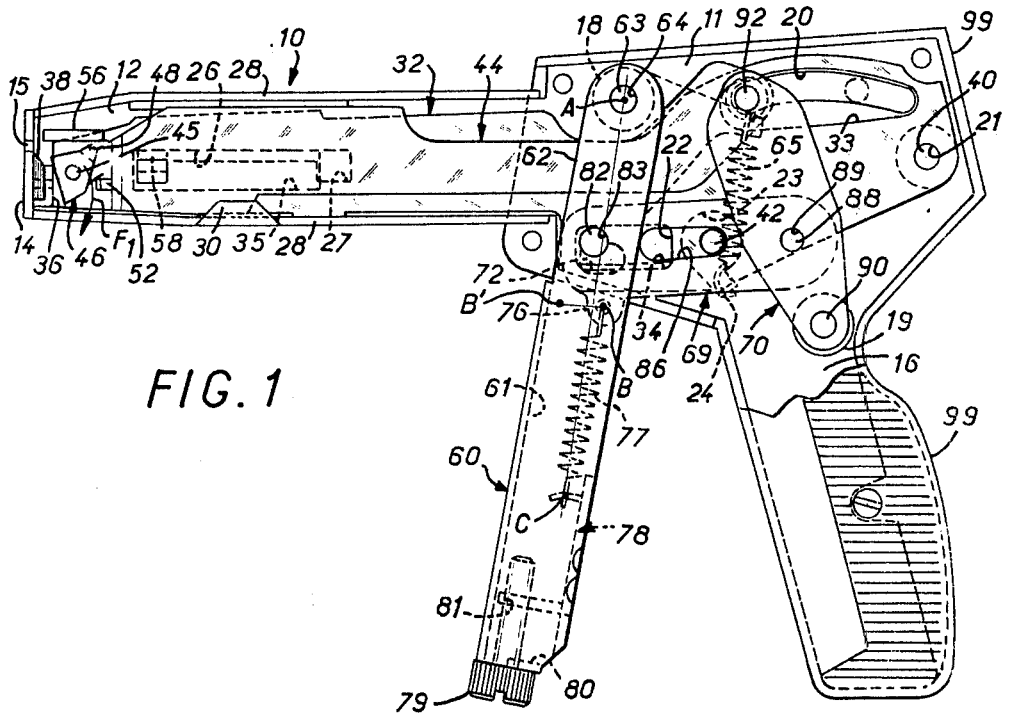
FIG. 1 is an elevation of a tool according to the invention.

Referring to the drawings, a tool for tightening and cutting-off a clamp comprises a support plate 10 having an overall outline similar to a hand-held firearm such as a pistol. The support plate 10 is suitably cut, perforated and ribbed whereby from an intermediate widened portion 11 projects a barrel-portion 12 having at its end a flange 14 bent at right-angles and cut away to form an intake opening 15 for the engagement of a clamp, and obliquely relative to the barrel-portion 12 a grip or butt-portion 16 to be gripped in the palm of the hand of an operator.

To the portion 11 of the support plate 10 are attached by crimping two tubular sleeves 18, 19, each of which can form a bearing, the first being located in the vicinity of the barrel-portion 12 and the second in the vicinity of the butt-portion 16, the two sleeves 18, 19 projecting from the plate 10 on the same side thereof as the flange 14 having the intake opening 15 projects.

At its end remote from the intake opening 15, the intermediate portion 11 of the plate 10 has a slot 20. In the embodiment shown the slot 20 is arcuate around the axis of the tubular sleeve 19.

In the vicinity of the end of the slot 20 which is furthest from the intake opening 15, the portion 11 of the plate 10 has an advantageously reinforced circular passage 21.

The portion 11 of the plate 10 also has two slots 22, 23 therein, the first slot 22 being rectangular and the second slot 23 circular, the latter having at its peripheray a tab 24 which projects from the surface of the plate opposite to that from which projects the flange 14 having the intake opening 15.

At its end close to the intake opening 15, the barrel-portion 12 of the pate 10 has an oblong slot 26 which extends longitudinally in substantially rectilinear manner and which terminates at its end opposite to the intake opening 15 with a widened portion 27.

The barrel-portion 12 has at each of its upper and lower sides a projecting flange 28 level with the flange 14.

The lower flange 28 has a generally trapezoidal upward projection 30 extending parallel to the plate 10 and subtantially opposite the slot 26.

A cutting lever 32 is pivotable between a rest position, as shown in FIG. 1 in which it leaves the intake opening 15 free and a working position, as shown in FIG. 5 where it obstructs the intake opening 15.

The cutting lever 32 in general outline corresponds to the outline of the barrel-portion 12 of the plate 10.

Corresponding respectively with the slots 20, 22 and 26 of the plate 10 it has slots 33, 34 and 35 respectively.

At its end corresponding to the flange 14 of plate 10, the cutting lever 32 has a bent portion 36 to which is secured, by means of a screw 37, a cutter 38 the cutting edge 39 of which extends transversely relative to the plate 10 and slightly obliquely relative thereto.

On the opposite end of the cutting lever 32 is fixed by crimping a pin 40, the pin 40 being pivotally engaged in the circular passage 21 of the plate 10.

Thus, the cutting lever 32 is pivoted on the end of the plate remote from the intake opening 15.

In its median area, the cutting lever 32 has a stud 42 projecting from the same face of the cutting lever as the bent portion 36. As will be gathered hereinafter, the stud 42 partly constitutes a means for controlling pivoting of the cutting lever 32 from its rest position to its working position and return from the working position to the rest position.

A displacement member 44 is provided to be movable longitudinally relative to the barrel-portion 12 of the plate 10 and is able to grip a clamp with a view to displacing the free end thereof.

The displacement member 44 is in the form of a movable plate extending substantially parallel to the plate 10 and superimposed on the cutting lever 32.

At its end corresponding to the front end of the barrel-portion 12 of the plate 10, the displacement member 44 has a laterally projecting pin 45 on which is pivotally mounted a ratchet 46, the ratchet 46 being axially held on said pin by a circlip 47 or other locking means.

The ratchet 46 has a generally triangular configuration and at one of its apices has transversely extending gripping teeth or ribs 48. At another of its apices it is cut-away to form a face 49.

The ratchet 46 is subject to the action of a torsion spring 50, one arm 51 of which is supported on a projection 52 of the displacement member 44 and the other arm 53 of which acts on a shoulder 55 of the ratchet 46 and rotates the latter in a direction to cause the gripping teeth 48 thereon to co-operate with a backing plate 56 to grip a clamp therebetween. The backing plate 56 is formed by a bent portion extending from the upper edge of the displacement member 44 above the pin 45 on which the ratchet 46 (FIG. 2) is mounted.

From the opposite face of the displacement member 44 projects spaced from the ratchet 46, a guidance tongue 58, bent in right-angled manner and engaged in the slot 35 of the cutting lever 32, the guidance tongue 58 also being engaged in the slot 26 of the barrel-portion 12 of the plate 10, such engagement being possible due to the widened portion 27 of the slot 26.

The cutting lever 32 also has a trigger 60 mounted in pivotal manner on the plate 10 adjacent the butt-portion 16 thereof and drawn by elastic means in the direction of a given rest position. A coupling linkage with a sudden release mechanism controlled by an elastic calibrating means is located between the trigger 60 and the displacement member 44.

Figure 2:
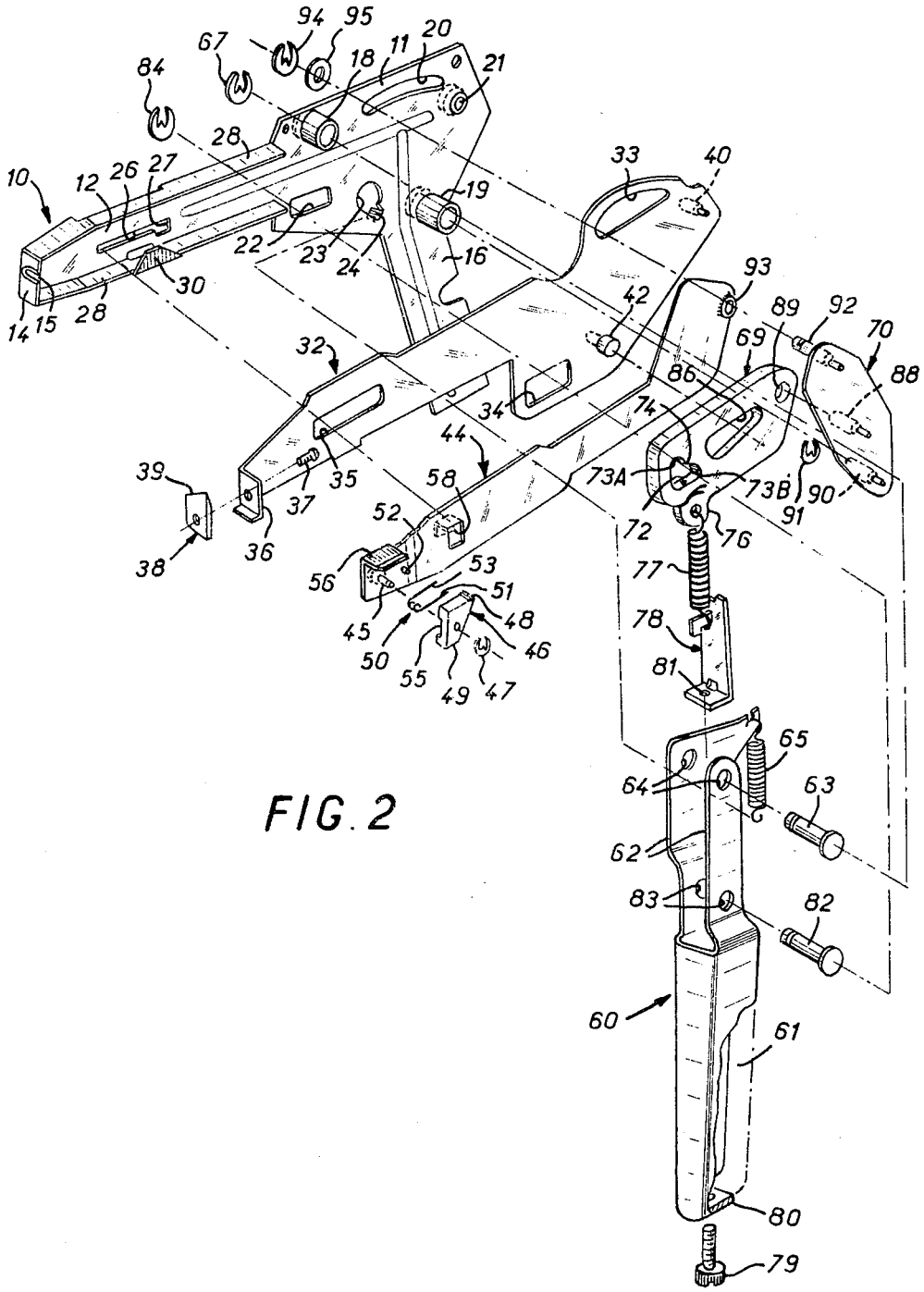
FIG. 2 is an exploded perspective view of the tool of FIG. 1 but with a casing omitted.

In its lower portion, the trigger 60 has a U-shaped cross-section and thus forms a recess 61 for locating, in a manner to be described hereinafter, the elastic calibrating means controlling the sudden release mechanism (FIG. 2).

The trigger 60 has a bifurcated upper end 62 by which it is engaged on the assembly of the intermediate portion 11 of the plate 10, the cutting lever 32 and the displacement member 44.

By means of a pivot pin 63 which extends through the sleeve 18 of the plate 10 and circular holes 64 in the bifurcated end 62 of the trigger 60, the trigger 60 is articulated on the plate 10.

To one of the arms of the bifurcated end 62 is coupled a spring 65, the other end of which is coupled to the tab 24 of the plate 10 and which thus constitutes elastic storing means which biases the trigger 60 towards its rest position.

A circlip 67 or other locking means axially maintains the pivot pin 63 of the trigger 60 (FIG. 2).

The coupling linkage with the sudden release mechanism between the trigger 60 and the displacement member 44 successively has a swinging link 69 and an amplification link 70 (FIG. 2).

The swinging link 69 is advantageously an appropriately cut plate and extends substantially parallel to the displacement member 44 (FIG. 1).

At one of its ends, it has a generally heart-shaped hole 72, whereof the sides of which form a cam surface having two separate stable zones 73A, 73B, separated from one another by an unstable zone 74 (FIG. 2).

At the same end, the swinging link 69 has a lug 76 by which it is joined to the end of a spring 77 located in the recess 61 of the trigger 60 and whose other end is joined to a slide 78 movable in the recess 61 of the trigger 60 under the control of a tension screw 79 accessible from the outside of the trigger. By its head, the screw 79 is supported in a bent end 80 of the trigger 60, transversely defining at its free end the recess 61, the screw 79 engaging in a threaded hole 81 in the slide 78.

Notches can be provided on the face of the trigger 60 for setting by reference marks the tension applied by the slide 78 to the spring 77, the latter constituting elastic calibrating means associated with the sudden release mechanism of which the swinging link 69 forms a part.

The heart-shaped hole 72 of the swinging link 69 is traversed by a pin 82 which is fixed to the trigger 60 by engagement in circular holes 83 in the bifurcated end 62 of the trigger 60 and is axially maintained relative to the latter by a circlip 84 (FIG. 2) or other suitable locking means.

Due to the action exerted by the spring 77 on the swinging link 69, the pin 82 which traverses the heart-shaped hole 72 is maintained in contact with the cam surface constituted by the opposite side of said hole and consequently the pin 82 constitutes a follower member with reference to the cam member constituted by the swinging link 69.

In its median area, the swinging link 69 has a second hole 86, which has a generally approximately rectilinear shape, traversed by the stud 42 which projects from the cutting lever 32 (FIGS. 1 and 2).

The hole 86 through one of its sides constitutes engagement means by which the swinging link 69 engages with the cutting lever 32, whereby in this connection the stud 42 of the cutting lever constitutes complementary engagement means of the supporting surface formed by said side of the hole 86.

In the same way, the other side of the hole 86 of the swinging link 69 forms together with the stud 42 restoring means for the cutting lever 32.

At its end opposite that carrying the heart-shaped hole 72, the swinging link 69 engages with the amplification link 70.

The swinging link 69 is pivotally articulated to the amplification link 70 by a pivot 88 which projects from the median area of the latter and engages in a circular passage 89 of the swinging link 69.

Furthermore, the amplification link 70, which extends adjacent the butt-portion 16 of the supporting plate 10 is articulated on the one hand to the plate 10 and on the other to the displacement member 44.

For this purpose, the amplification link 70 has at its lower end a tranversely projecting pin 90 which pivotally engages in the bearing sleeve 19 of the intermediate portion 11 of the plate 10, with a circlip 91 or other locking means axially to maintain the assembly, whilst at its upper end it has a pin 92 pivotally engaged in a circular passage 93 at the rear end of the displacement member 44 (FIGS. 1 and 2).

The pin 92 is extended beyond the displacement member 44 and after traversing the slot 33 at the rear upper end of the cutting lever 32, traverses the arcuate slot 20 in the intermediate portion 11 of the plate 10, the assembly being axially maintained beyond the plate 10, by a circlip 94 or other locking means, following the optionally interpositioning of a washer 95.

Preferably and as shown, a casing is associated with the plate 10 and is fixed to the latter.

The casing can comprise two shells 99 (FIG. 1), extending around the widened intermediate portion 11 and the butt-portion 16 of the plate 10, whereby said two shells grip the plate 10 and the members carried by the latter and are interconnected by screws which traverse passages provided for this purpose in the plate 10.

In the rest position of FIG. 1, the cutter 38 carried by the cutting lever 32 leaves free the intake opening 15 of the plate 10.

The return spring 65 associated with the trigger 60 biases the trigger to a position in which the trigger is spaced from the butt portion 16 of the plate 10 and, via the coupling linkage connecting the same to the displacement member 44, the trigger 60 consequently biases the displacement member 44 in the direction of the bent portion 14 of the plate 10 which has the intake opening 15 therein.

In practice, the rest position of the assembly is defined by abutment of the front end of the displacement member 44 against the bent portion 36 of the cutting lever 32 carrying the cutter 38.

The bent portion 36 of the cutting lever 32 against which bears the ratchet 46 carried by the corresponding front end of the displacement member 44 compels the ratchet to pivot in the direction of arrow F1 in FIG. 1 so that, in opposition to the spring 50 which is associated therewith, the ratchet 46 moves away from the backing plate 56 so that between the ratchet 46 and the backing plate 56 is left a free passage.

Furthermore, the pin 82 which is fixed to the trigger 60 and which forms a cam follower for the cam surface formed by one of the sides of the hole 72 of the swinging link 69 is in engagement with the active zone 73A of the cam surface which is further from the spring 77 to which is coupled the swinging link 69 (FIGS. 1 and 6).

For its operation and for cutting the free end 98 of a clamp 100 fastened round any random articles to be joined together (FIG. 3), the free end 98 of the clamp 100 is engaged through the intake opening 15 of the plate 10.

During its engagement, the free end 98 of the clamp 100 forces the ratchet 46 carried by the displacement member 44 to move even further from the backing plate 56 which is associated therewith and the ratchet, moved elastically by its spring 50 in the direction of the backing plate 56 is anchored by its gripping teeth 48 in the free end 98 of the clamp 100, which from then on can be moved by the displacement member 44.

Figure 3:
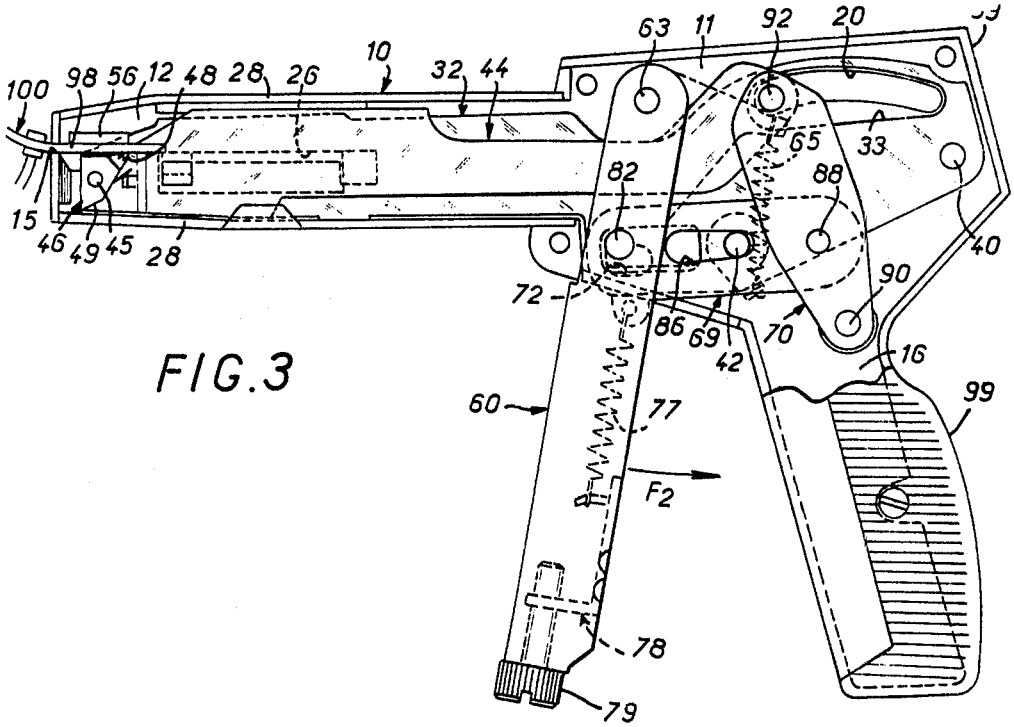

The operator, who grips the tool in the manner of a pistol and whose palm is supported on the butt portion 16 of the plate 10 or more precisely on the casing shells 99 surrounding the butt portion 16, pulls the trigger 60 to pivot it about the pin 63 as indicated by arrow F2 in FIG. 3.

The pin 82 of the trigger 60 is subjected to a force F5 (FIG. 6), whose components are on the one hand a driving force F4 exerted by the operator according to the radial direction of the pin 82 corresponding to the pivoting of the trigger 60 and on the other a force F7 whose direction is that of the axis of the spring 77, being directed in the opposite direction to a force F8 exerted by the spring 77 on the swinging link 69.

At the start of the pivoting action applied to the trigger 60, the resistance exerted with respect to this pivoting action by the clamp whose free end 98 is moved by the displacement member 44 is small and the force F7 applied to the swinging link 69 by the pin 82 is less than the force F8 applied thereto by the spring 77 constituting the calibrating means associated with said swinging link.

Thus, the pin 82 integral with the trigger 60 remains in engagement with the active zone 73A of the heart-shaped opening 72 of the swinging link 69 further from the spring 77.

Driven rearwards by the pin 82, the swinging link 69 in turn forces backwards the amplification link 70 and the latter, by pivoting about the pin 90, draws rearwards the displacement member 44 as indicated by arrow F10 in FIG. 4.

The free end 98 of the clamp 100 is gripped between the ratchet 46 and the backing plate 56 and as the displacement member 44 is moved rearwardly the clamp is progressively tigthened onto the articles which it encircles in proportion to the pivoting of the trigger 60 in accordance with arrow F2. It therefore offers an increasing resistance to said pivoting movement.

When this resistance increases to such an extent that the force F7 applied to the swinging link 69 by the pin 82, as described hereinbefore, becomes greater than the force F8 applied to the swinging link 69 by the spring 77, the pin 82 suddenly crosses the unstable zone 74 separating the stable zone 73A of the corresponding cam surface and engages with the zone 73B, as shown by dotted lines in FIG. 6.

As a result, the swinging link 69 suddenly pivots about the pin 88 by which it is in engagement with the amplification link 70 in accordance with arrow F11 of FIGS. 5 and 6.

Since the swinging link 69 is in engagement by its hole 86 with the stud 42 of the cutting lever 32, the swinging link 69 causes, during its sudden pivoting, a concomitant sudden pivoting of the cutting lever 32 about its pin 40 (FIG. 5).

This pivoting of the cutting lever 32 causes the cutter 38 carried thereby to cut off the free end 98 of the clamp 100, said cutting action being enhanced by the tension in the clamp, so that even the slightest cutting brings about the tearing through thereof.

If the pivoting movement applied to the trigger 60 is continued, the displacement member 44 continues its movement away from the intake opening 15 of the plate 10 in such a way that the ratchet 46 comes into contact via its face 49 with the trapezoidal projection 30 on the edge of the barrel-portion 12 of the plate 10, which causes a rotational movement (FIG. 7) which is sufficient to ensure the freeing of the cut-off end of the clamp.

When the pivoting action exerted on the trigger 60 is stopped, the return spring 65 ensures the return of the assembly of movable components to their rest position, as described hereinbefore.

Hereinbefore, the clamp has been cut when it was under tension.

However, by the action of a retractable stop 105 suitable for limiting the travel of the displacement member 44, it is possible to bring about this cutting action when the tension applied to the clamp is minimal.

As indicated by broken lines in FIG. 1, the retractable stop 105 can be introduced into the slot 20 of the plate 10 traversed by the pin 92 which couples the amplification link 70 to the displacement member 44.

The retractable stop 105 can be carried by a lever mounted so as to pivot between two positions, namely a first position for which said stop is spaced from the slot 20 and a second position for which it is located in the slot 20.

However, the retractable stop could co-operate in abutment with almost any one of the movable components of the tool and still bring about the same effect.

Thus, when the retractable stop is in action it limits the displacement movement of the corresponding member and consequently of the trigger 60 in such a way that if the pivotal action exerted on the trigger is continued, there is a sudden pivoting of swinging link 69 and therefore of the cutting lever 32, in the same way as described hereinbefore.

The invention is not limited to the embodiment described above, many variations being possible within the scope of the appended claims.

For example, if the cam member of the sudden release mechanism is formed on the swinging link 69 by the heart-shaped hole 72 for co-operation with the cam follower formed in this connection by the pin 82 integral with the trigger 60, it is obvious that the relative locations of the cam member and of the cam follower could be inverted between the trigger 60 and the swinging link 69, i.e. the swinging link 69 could carry a pin forming a cam follower for a cam surface formed on a cam integral with the trigger.

A single support surface between any one of the swinging rod/cutting lever members for the purpose of co-operating with a stud or a complementary support surface provided for this purpose on the other of said member could be provided with return means such as a spring to ensure return to the rest position of the cutting lever.

In the same way, the swinging link 69 is not necessarily articulated to the amplification link 70 and it would suffice for it to be in engagement with the latter by a support.

The slots 26 and 20 of the plate 10 serve for the sliding of the displacement member 44. If desired the slot 20 could be rectilinear, whereby the pin 92 articulating the displace-member member 44 to the amplification link 70 could be carried by the displacement member, whilst the amplification link 70 could have a fork-like end by which it is engaged on the pin.

The amplification link 70 could extend along the butt portion 16 of the plate 10, whilst being at least partly superimposed on the butt portion according to the desired amplification ratios.

It is also possible by action on the spring 79 to control the force exerted on the swinging link 69 by the spring 77 constituting the elastic calibrating means associated with the latter and thus control the tension beyond which a clamp is cut, whereby said tension is advantageously independent on the operator.

It is also possible to eliminate the spring 65 used for returning the trigger 60 to its rest position by giving this function to the spring 77 constituting the elastic calibrating means associated with the sudden release mechanism.

For the rest position shown in FIG. 1, it would merely be necessary for a position B on the swinging link 69 to which is coupled the spring 77 to be transversely displaced in the direction of the intake opening 15, to the position B′ in FIG. 1 relative to the line joining the axis A of the pivot 63 of the trigger to a position C thereof to which is coupled the spring 77. The spring 77 then tends to align positions A, B′ and C, thereby subjecting the trigger to an elastic restoring force biasing it in the direction of its rest position.

What is claimed is:

1. A tool for tightening clamps, of the kind comprising a flexible strip and an apertured head, having a passage in which the end of the flexible strip can be engaged after the strip has been passed around a bunch of articles to be clamped together and through the apertured head, the tool being used to cut-off that portion of the flexible strip of the clamp which projects beyond the apertured head following tightening to a greater or lesser degree of the clamp around the articles, the tool comprising a plate having a transverse portion at one of its ends formed to define an intake opening to receive said portion of the flexible strip of a clamp and at the other of its ends a fixed grip; a displacement member mounted for movement longitudinally of said plate and including means capable of gripping said portion of a clamp; a trigger pivotally mounted on said plate for movement relative to said fixed grip; coupling means including a swinging link provided between said displacement member and said trigger and including a release mechanism controlled by elastic calibrating means; a cutting lever pivotally mounted between a rest position where it leaves free said intake opening of said plate and a working position and with which are associated restoring means which draw said cutting levers in the direction of said rest position; said release mechanism comprising a cam having a cam surface with two separate stable zones separated from one another by an unstable zone and a cam follower maintained in contact with the cam surface of the cam by elastic calibrating means, said cam and said cam-follower being relatively movable within limits defined by said cam surface thereby to swing said cutting lever from said rest position into said working position, one of said cam and said cam-follower being fixed to said trigger and the other being provided on said swinging link of said coupling means provided between said trigger and said displacement member, said elastic calibrating means being coupled to said swinging link and said swinging link having engagement means engaged with complementary engagement means fixed to said cutting lever.

2. A tool as claimed in claim 1, wherein the cam is formed on the swinging link.

3. A tool as claimed in claim 2, wherein said swinging link is formed to define a heart-shaped hole, opposite sides of which hole define said stable zones of said cam surface and said cam follower comprises a pin integral with said trigger and engaged in said heart-shaped hole.

4. A tool as claimed in claim 3, wherein said swinging link also has a slot therein, one of the sides of said slot forming said engagement means provided between said swinging link and said cutting lever and another of the sides of said slot forming said restoring means, said cutting lever carrying a pin or stud which traverses said slot.

5. A tool as claimed in claim 1, wherein said swinging link has engagement means by which it engages with complementary engagement means of said coupling means provided between said trigger and said displacement member.

6. A tool as claimed in claim 5, wherein said swinging link engages with an amplification link articulated to said displacement member, said amplification link being articulated to said fixed plate.

7. A tool as claimed in claim 1, wherein said elastic calibrating means are located in said trigger.

8. A tool as claimed in claim 1, including for the guidance of said displacement member, a slot in said plate at said one of its ends and a projection on said displacement member, which projection slidingly engages in said slot.

9. A tool as claimed in claim 8, including for the further guidance of said displacement member, a further slot in said plate at its other end and a further projection on said displacement member, which further projection slidingly engages in said further slot.

10. A tool as claimed in claim 1, wherein said displacement member extends parallel to said supporting plate and said displacement member is superimposed on said cutting lever.

11. A tool as claimed in claim 1, including a retractable stop to limit travel of said displacement member.

12. A tool as claimed in claim 1, wherein said trigger is biassed by said elastic calibrating means of said release mechanism in a direction away from said fixed grip.

13. A tool as claimed in claim 12, wherein a position on said swinging link to which said elastic calibrating means is connected is displaced towards said one end of said plate relative to a line joining the articulation axis of said trigger to a position on said trigger at which said elastic calibrating means are connected to said trigger.

* * * * *